US012742573B2

(12) United States Patent
Crispel et al.

(10) Patent No.: US 12,742,573 B2
(45) Date of Patent: Sep. 22, 2026

(54) DILUTION REFRIGERATION DEVICE AND METHOD

(71) Applicant: L'Air Liquide, Societe Anonyme pour l'Etude et l'Exploitation des Procedes Georges Claude, Paris (FR)

(72) Inventors: Simon Crispel, Sassenage (FR); Alain Ravex, Meylan (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 896 days.

(21) Appl. No.: 17/800,982

(22) PCT Filed: Feb. 3, 2021

(86) PCT No.: PCT/EP2021/052495
§ 371 (c)(1),
(2) Date: Aug. 19, 2022

(87) PCT Pub. No.: WO2021/165042
PCT Pub. Date: Aug. 26, 2021

(65) Prior Publication Data

US 2023/0107973 A1 Apr. 6, 2023

(30) Foreign Application Priority Data

Feb. 21, 2020 (FR) ..... 2001727

(51) Int. Cl.
*F25B 1/00* (2006.01)
*F25B 41/00* (2021.01)

(52) U.S. Cl.
CPC ..... *F25B 1/00* (2013.01); *F25B 41/00* (2013.01)

(58) Field of Classification Search
CPC .... F25B 1/00; F25B 41/00; F25B 9/10; F25B 9/14; F25B 9/12; F25D 19/006
See application file for complete search history.

(56) References Cited

U.S. PATENT DOCUMENTS 3,581,512 A * 6/1971 Staas ..... F25B 9/12 62/610
4,672,823 A * 6/1987 Benoit ..... F17C 3/085 62/50.1

(Continued)

FOREIGN PATENT DOCUMENTS

EP 0212093 A2 * 3/1987 ..... F25B 9/12
EP 1541938 A1 * 6/2005 ..... F25B 13/00

(Continued)

OTHER PUBLICATIONS

International Search Report and Written Report for PCT/EP2021/052495, mailed Apr. 21, 2021.
French Search Report for FR 2 001 727, mailed Oct. 30, 2020.

*Primary Examiner* — Joel M Attey
*Assistant Examiner* — Ibrahim A. Michael Adeniji
(74) *Attorney, Agent, or Firm* — Justin K. Murray

(57) ABSTRACT

Dilution refrigeration device and method comprising a loop working circuit containing a working fluid comprising a mixture of helium-3 (3He) and helium-4 (4He), the working circuit comprising, arranged in series and fluidically connected via a first set of pipes, a mixing chamber, an evaporator and transfer member, the first set of pipes being configured to transfer the working fluid from an outlet of the mixing chamber to an inlet of the evaporator and from an outlet of the evaporator to an inlet of the transfer member, the working circuit comprising a second set of pipes connecting an outlet of the transfer member to an inlet of the mixing chamber, the working circuit comprising at least a first heat-exchange portion for exchange of heat between at (Continued)

least part of the first set of pipes and the second set of pipes, the first heat-exchange portion being situated between the evaporator and the mixing chamber, the device further comprising at least one cooling member in a heat-exchange relationship with the working circuit, the device comprising at least one cryogenic pumping member situated in the working circuit between the evaporator and the transfer member.

21 Claims, 8 Drawing Sheets

(56) References Cited

U.S. PATENT DOCUMENTS

| | | | | |
|---|---|---|---|---|
| RE33,878 | E * | 4/1992 | Bartlett | F25J 1/0276 62/51.1 |
| 6,438,969 | B1 * | 8/2002 | Laskaris | H02K 55/04 62/51.1 |
| 6,442,949 | B1 * | 9/2002 | Laskaris | H02K 55/04 62/505 |
| 6,679,066 | B1 * | 1/2004 | Funayama | F25B 25/005 62/500 |
| 2002/0007637 | A1 * | 1/2002 | Simmons | F25B 9/14 62/430 |
| 2008/0016907 | A1 * | 1/2008 | Barclay | F25J 1/0015 62/612 |
| 2009/0224862 | A1 * | 9/2009 | Mikheev | H01F 6/04 335/216 |
| 2011/0185766 | A1 * | 8/2011 | Benoit | F25B 9/12 62/610 |
| 2015/0153427 | A1 * | 6/2015 | Garside | F25B 9/00 324/318 |
| 2015/0316315 | A1 * | 11/2015 | Bernhardt | F25J 1/0268 62/608 |
| 2015/0345834 | A1 * | 12/2015 | Barjhoux | F25J 1/0276 62/6 |
| 2018/0112928 | A1 * | 4/2018 | Dorr | F25B 9/12 |
| 2019/0041103 | A1 * | 2/2019 | Kelly | F25B 9/12 |
| 2020/0370792 | A1 * | 11/2020 | Matthews | F25B 9/12 |
| 2023/0008279 | A1 * | 1/2023 | Tillemann-Dick | B22F 1/0547 |
| 2024/0051675 | A1 * | 2/2024 | Staempflin | F25B 9/06 |

FOREIGN PATENT DOCUMENTS

| | | | |
|---|---|---|---|
| JP | 2001 304 709 | 10/2001 | |
| JP | 2001304709 A * | 10/2001 | |
| JP | 2004 257 719 | 9/2004 | |
| JP | 2007 333 273 | 12/2007 | |
| KR | 20130142201 A * | 12/2013 | F25B 25/005 |

* cited by examiner

[Fig. 1]
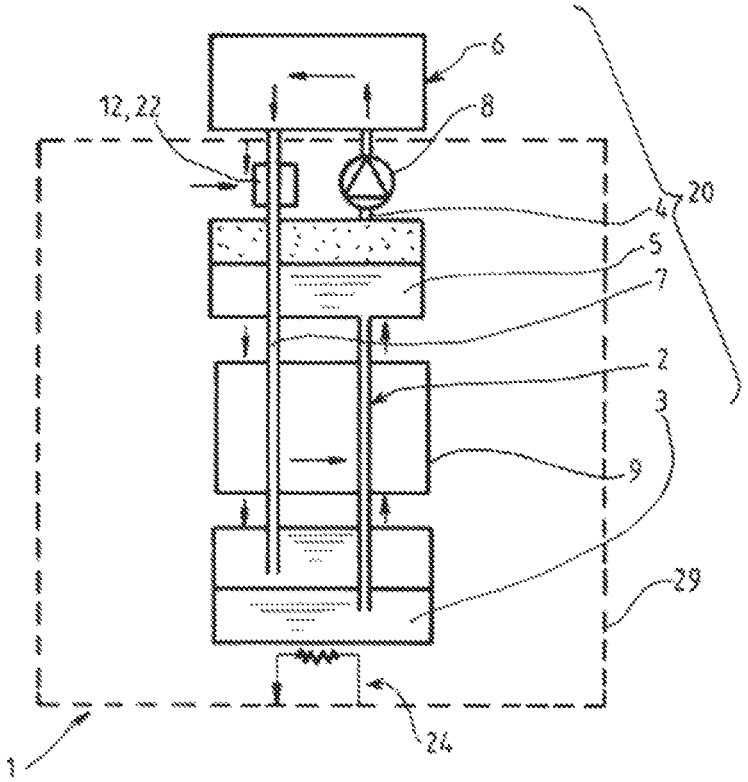

[Fig. 2]
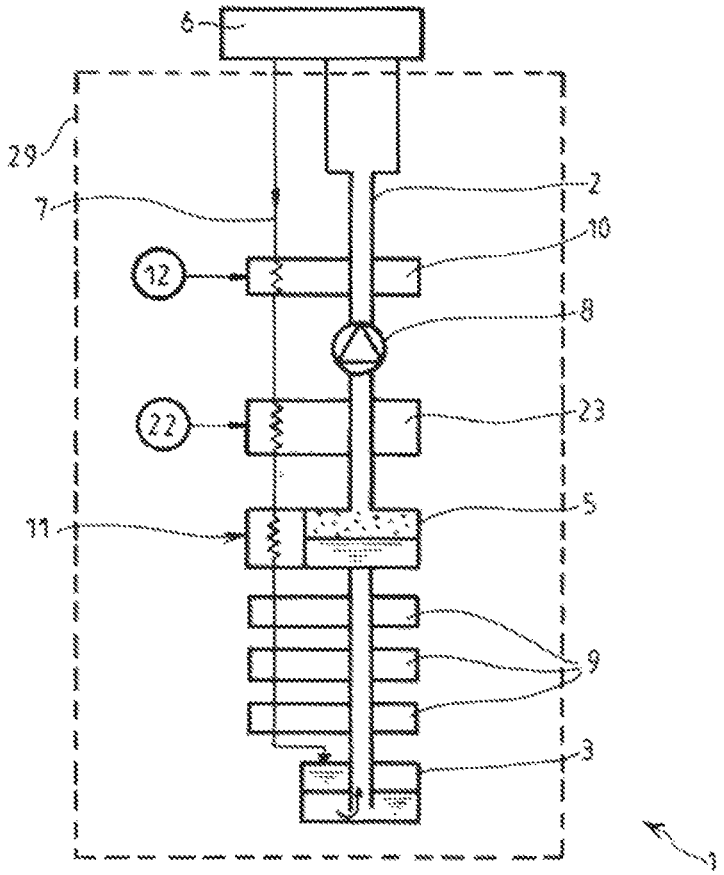

[Fig. 3]
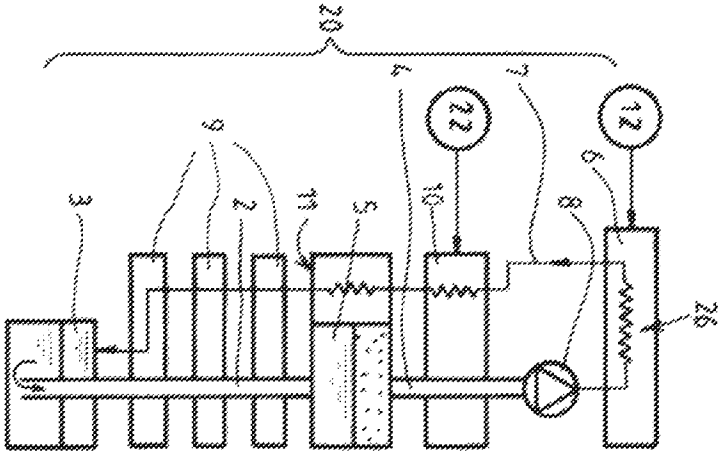

[Fig. 4]
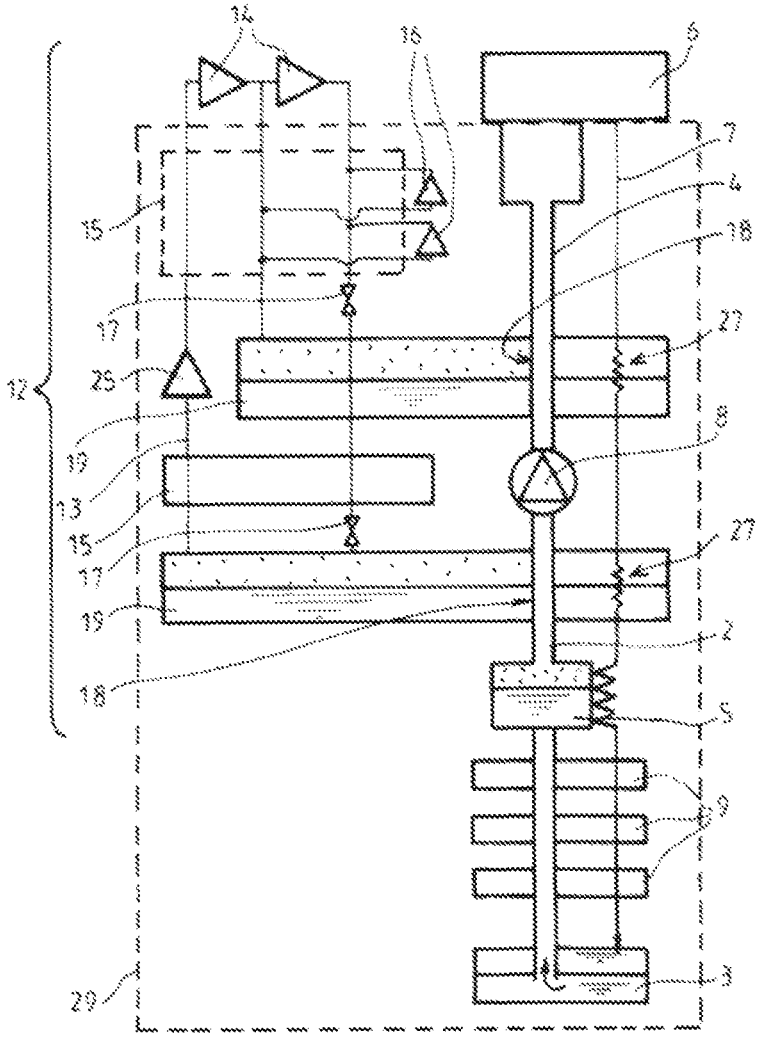

[Fig. 5]
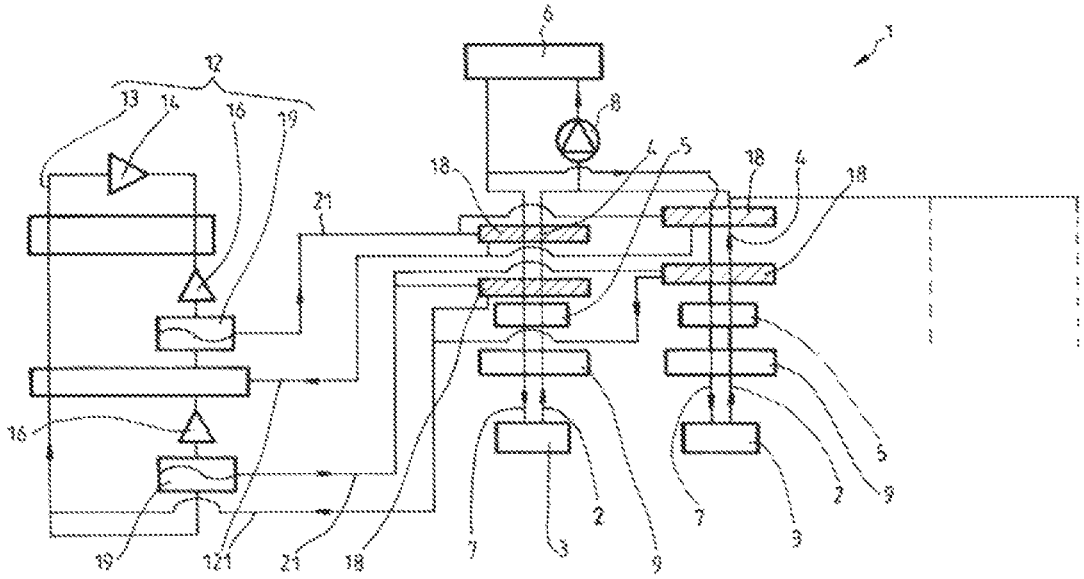
[Fig. 6]
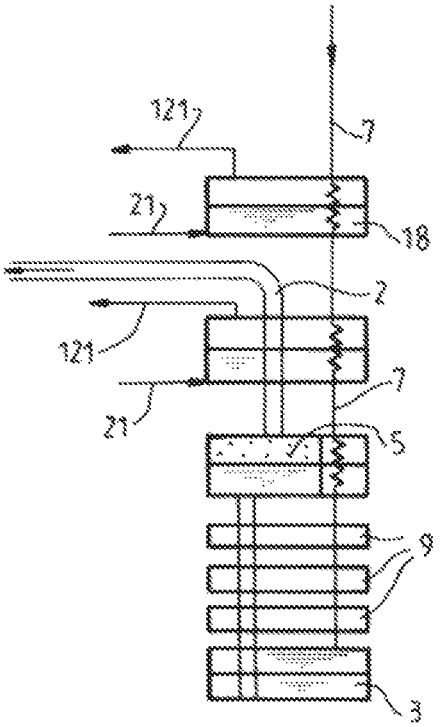

[Fig. 7]
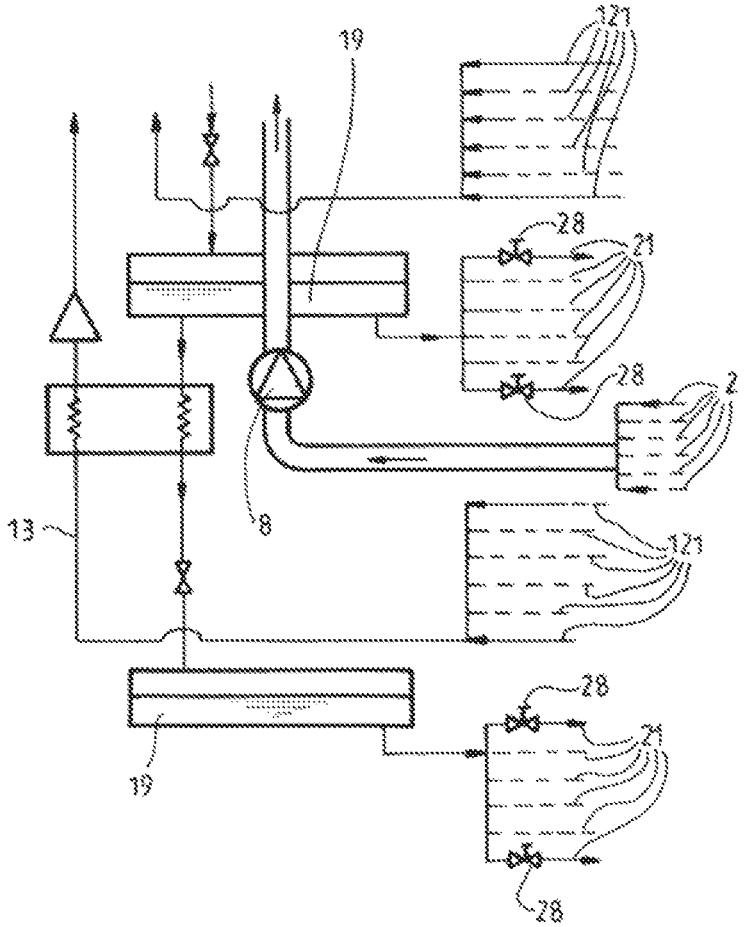

[Fig. 8]
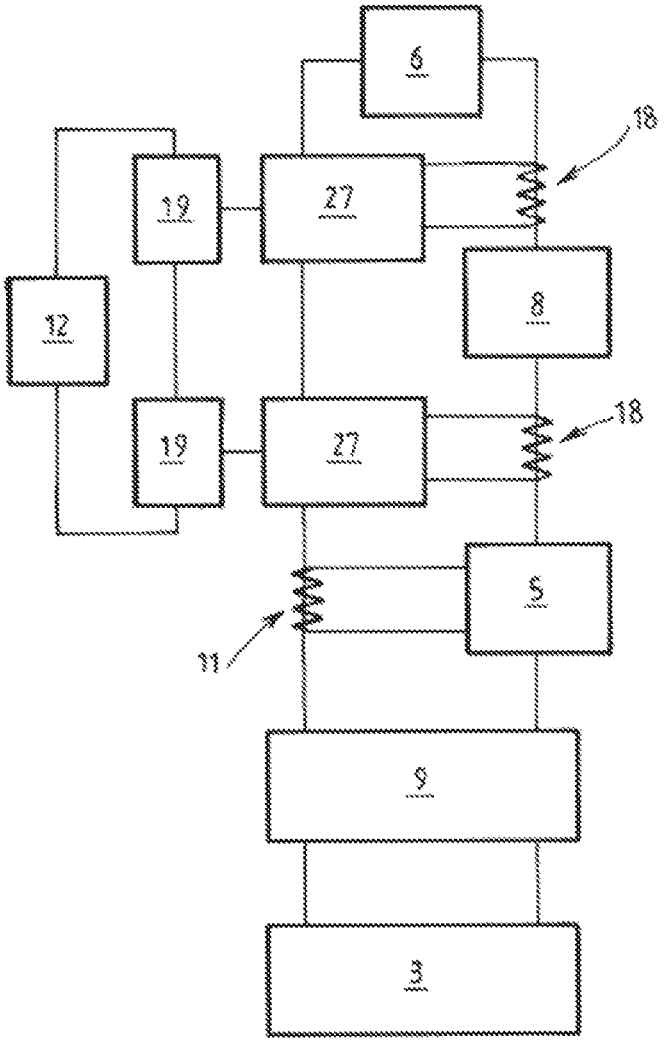

[Fig. 9]
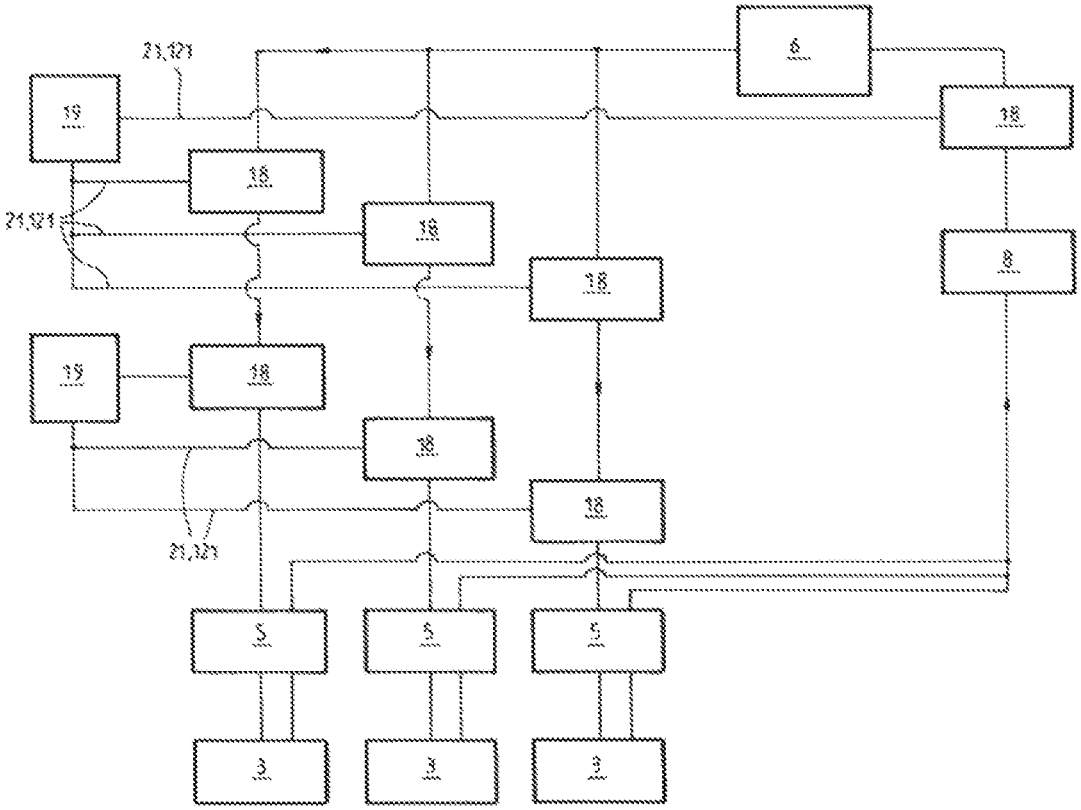

DILUTION REFRIGERATION DEVICE AND METHOD

CROSS-REFERENCE TO RELATED APPLICATIONS

This application is a § 371 of International PCT Application PCT/EP2021/052495, filed Feb. 3, 2021, which claims § 119(a) foreign priority to French patent application FR 2001727, filed Feb. 21, 2020.

BACKGROUND

Field of the Invention

The invention relates to a dilution refrigeration device and method.

The invention relates more particularly to a dilution refrigeration device for achieving very low temperatures, in particular in the range between one and around 100 millikelvin, comprising a working circuit in the form of a loop containing a cycle fluid comprising a mixture of helium-3 and helium-4, the working circuit comprising a mixing chamber, a boiler and a transfer member, which are disposed in series and fluidically connected via a first set of pipes, the first set of pipes being configured to transfer cycle fluid from an outlet of the mixing chamber to an inlet of the boiler and from an outlet of the boiler to an inlet of the transfer member, the working circuit comprising a second set of pipes connecting an outlet of the transfer member to an inlet of the mixing chamber, the working circuit comprising at least a first portion for heat exchange between at least a part of the first set of pipes and the second set of pipes, the first heat exchange portion being situated between the boiler and the mixing chamber, the device also comprising at least one cooling member which is in heat exchange with the working circuit and is configured to transfer cold energy to the cycle fluid.

The invention relates in particular to a low-temperature or very-low-temperature (meaning potentially down to the temperature range from one to around 100 millikelvin) high-power cryogenic refrigeration device and method.

Related Art

Refrigeration at temperatures lower than around 100 millikelvin is used for the most part in applications for studying matter and quantum phenomena, for the production of electromagnetic radiation detectors.

Quantum phenomena give rise to theoretical and technological developments that are capable of implementing them to carry out operations ("quantum computing") for the development of supercomputers (which carry out for example a billion calculations per second) by manipulating superconducting "qubits" at temperatures close to one millikelvin or based on silicon at several hundred millikelvin.

Generally, these applications use dilution refrigerators for cooling purposes, allowing them to manipulate around 100 qubits and integrate the hundreds of wired or coaxial connections (around 4 per qubit) that are necessary for controlling them and reading their status.

Thus, the traditional means of obtaining the refrigeration power at temperatures of around one millikelvin to around 100 millikelvin is the helium-3/helium-4 dilution refrigerator.

Other technologies afford cooling powers of 8 to 30 microwatts at 20 mK or 250 to 1000 microwatts at 100 mK.

In order to ultimately manipulate tens of thousands and up to millions of qubits in an "exascale" quantum computer, the existing refrigeration solutions are no longer suitable.

SUMMARY OF THE INVENTION

An aim of the present invention is to overcome all or some of the drawbacks of the prior art that are set out above.

To this end, the device according to the invention, which is otherwise in accordance with the generic definition thereof given in the above preamble, is essentially characterized in that it comprises at least one cryogenic pumping member situated in the working circuit between the boiler and the transfer member.

Furthermore, embodiments of the invention may have one or more of the following features:

- the transfer member comprises a cycle fluid compressor,
- the transfer member comprises a heat exchanger,
- the at least one cryogenic pumping member is situated in the first set of pipes of the working circuit, and, in the operating configuration of the refrigeration device, the cycle fluid is admitted into it at a cryogenic temperature, in particular between 0.5K and 80K,
- the at least one cryogenic pumping member is configured to pump the cycle fluid at an intake pressure of between 0.01 mbar and 100 mbar,
- the device has a second portion for heat exchange between at least a part of the first set of pipes and the second set of pipes and situated between the boiler and the transfer member, the at least one cryogenic pumping member being situated between the second heat exchange portion and the boiler and/or between the second heat exchange portion and the transfer member,
- the at least one cooling member has a cooling apparatus in heat exchange with the second set of pipes between the transfer member and the mixing member, the cooling member being configured to cool the cycle fluid of the dilution refrigeration device,
- the device has a portion for heat exchange between the second set of pipes and the boiler,
- the at least one cooling member comprises a cryogenic refrigerator comprising a working circuit that forms a loop and contains a working fluid comprising helium, the working circuit forming a cycle comprising, in series: a mechanism for compressing the working fluid, a mechanism for cooling the working fluid, a mechanism for expanding the working fluid and a mechanism for heating the working fluid, the refrigerator comprising at least one portion for heat exchange between the working fluid expanded in the expansion mechanism and at least a part of the cycle fluid of the dilution refrigeration device,
- the cryogenic refrigerator comprises at least one tank for storing liquefied working gas downstream of the mechanism for expanding the working fluid, the refrigerator being configured to liquefy the working fluid in said tank, the at least one portion for heat exchange between the expanded working fluid and at least a part of the cycle fluid of the dilution refrigeration device comprising heat exchange between the liquefied working fluid situated in the at least one tank and the cycle fluid of the dilution refrigeration device,
- the cryogenic refrigerator comprises at least two tanks for storing liquefied working gas which are situated at separate locations in the working circuit, the refrigerator being configured to liquefy cycle fluid in said tanks at different respective temperatures, the liquefied working fluids situated in said tanks being placed in heat exchange with the cycle fluid of the dilution refrigeration device at separate respective locations in the working circuit of the dilution refrigeration device, the working circuit comprises a plurality of dilution loops that each have respective mixing chambers and boilers, meaning that the cycle fluid working circuit comprises a plurality of separate first sets of pipes and a plurality of separate second sets of pipes, at least some of the plurality of dilution loops comprise a common transfer member, meaning that the cycle fluid circulating in a plurality of dilution loops passes through one and the same shared transfer member, the corresponding first sets of pipes and second sets of pipes being connected in parallel to the common transfer member, at least some of the plurality of dilution loops comprise a common pumping member, meaning that the cycle fluid circulating in a plurality of dilution loops passes through one and the same shared pumping member, the corresponding first sets of pipes and/or second sets of pipes being connected in parallel to said common pumping member, at least some of the plurality of dilution loops each comprise a respective separate pumping member, the at least one cooling member has a common cooling apparatus for cooling at least some of the plurality of separate dilution loops, the common cooling apparatus comprises a cryogenic refrigerator comprising a working circuit that forms a loop and contains a working fluid containing helium, the working circuit forming a cycle comprising, in series: a mechanism for compressing the working fluid, a mechanism for cooling the working fluid, a mechanism for expanding the working fluid and a mechanism for heating the working fluid, the refrigerator comprising at least one portion for heat exchange between the working fluid expanded in the expansion mechanism and at least a part of the cycle fluid of the plurality of separate dilution loops of the dilution refrigeration device, the cryogenic refrigerator forming the common cooling apparatus comprises at least one tank for storing liquefied working gas downstream of the mechanism for expanding the working fluid, the refrigerator being configured to liquefy the working fluid in said at least one tank, the refrigeration device comprising a transfer pipe connecting said at least one storage pipe to at least one portion of at least some of the plurality of separate dilution loops of the dilution refrigeration device in order to ensure heat exchange between the working fluid and the cycle fluid in each of said dilution loops of the dilution refrigeration device, the cryogenic refrigerator forming the at least one common cooling member comprises at least two tanks for storing liquefied working gas which are situated at separate locations in the working circuit, the refrigerator being configured to liquefy cycle fluid in said tanks at different respective temperatures, and in that the refrigeration device has a set of transfer pipes connecting the storage tanks respectively to separate portions of at least some of the plurality of dilution loops of the dilution refrigeration device, in order to ensure exchanges of heat between the working fluid and the cycle fluid in said dilution loops of the dilution refrigeration device.

The invention may also relate to any alternative device or method comprising any combination of the features above or below within the scope of the claims.

BRIEF DESCRIPTION OF THE FIGURES

Further particular features and advantages will become apparent from reading the following description, which is given with reference to the figures, in which:

FIG. 1 shows a schematic and partial view illustrating a first example of the structure and operation of a refrigeration device according to the invention, FIG. 2 shows a schematic and partial view illustrating a second example of the structure and operation of a refrigeration device according to the invention, FIG. 3 shows a schematic and partial view illustrating a third example of the structure and operation of a refrigeration device according to the invention, FIG. 4 shows a schematic and partial view illustrating a fourth example of the structure and operation of a refrigeration device according to the invention, FIG. 5 shows a schematic and partial view illustrating a fifth example of the structure and operation of a refrigeration device according to the invention, FIG. 6 shows a schematic and partial view illustrating a detail of a sixth example of the structure and operation of a refrigeration device according to the invention, FIG. 7 shows a schematic and partial view illustrating another detail of the sixth example of the structure and operation of a refrigeration device according to the invention, FIG. 8 shows another, simplified view of the fourth example of the structure and operation of a refrigeration device according to the invention, FIG. 9 shows another, simplified view of the fifth example of the structure and operation of a refrigeration device according to the invention.

DETAILED DESCRIPTION OF THE INVENTION

The dilution refrigeration device 1 shown in [FIG. 1] comprises a working circuit 20 in the form of a look containing a cycle fluid comprising a mixture of helium-3 ("3He") and helium-4 ("4He"). This working circuit 20 comprises a mixing chamber 3, a boiler 5 and a transfer member 6, which are disposed in series and connected fluidically via a first set of pipes 2, 4.

The first set of pipes 2, 4 is configured to transfer cycle fluid from an outlet of the mixing chamber 3 to an inlet of the boiler 5 and from an outlet of the boiler 5 to an inlet of the transfer member 6.

The working circuit 20 comprises a second set of pipes 7 connecting an outlet of the transfer member 6 to an inlet of the mixing chamber 3.

The boiler 5 (or evaporator) conventionally carries out phase separation between the helium-3 and the helium-4 (the bath, which contains for example 1 mol % of helium-3, is, for example, at a temperature of between 0.7 and 1 K). The boiler 5 supplies the transfer member 6 with helium-3 via the first set of pipes 4.

In the mixing chamber 3, the temperature may be around for example 5 to 300 mK, and in particular between 5 and 150 mK. The concentrated liquid helium-3 returned into the mixing chamber 3 by the transfer member 6 may be located in the upper part of this chamber 3, above a diluted liquid phase (containing for example 6 to 7% helium-3). One end of the first set of pipes 7 leads for example into this upper concentrated phase.

In the mixing chamber 3, the injected concentrated phase of helium-3 is diluted in the diluted phase, and it is this endothermic dilution process that produces the cooling power at the temperature of the mixing chamber 3.

The cold produced may be used to cool a user (symbolized by the reference 24 in [FIG. 1]).

The working circuit 20 comprises at least one first portion 9 for heat exchange between at least a part of the first set of pipes 2, 4 and the second set of pipes 7. The first heat exchange portion 9 is situated between the boiler 5 and the mixing chamber 3.

This heat exchange portion 9 uses, for example, at least one counter-current heat exchanger, which makes it possible to pre-cool the concentrated helium-3 phase reinjected into the mixing chamber 3 by way of the diluted helium-3 phase, which rises from this mixing chamber 3 to the boiler 5.

The efficiency of the counter-current heat exchangers 9 between the diluted phase and concentrated phase is the critical point of these dilution refrigerators. The thermal resistances known as Kapitza resistances that arise at very low temperatures between helium and the solid materials and increase as the inverse square of the temperature make the dimensioning of these exchangers very difficult and critical.

In the example in [FIG. 1], the transfer member 6 comprises for example a cycle fluid compressor. For example, this compressor 6 operates at ambient temperature (for example outside a cold box 29 that contains the rest of the device). This means that this compressor 6 can be at a non-cryogenic temperature in the operating configuration of the dilution refrigeration device 1.

The device 1 also comprises at least one cooling member 22 in heat exchange with the working circuit 20 and configured to transfer cold energy to the cycle fluid, that is to say to cool the cycle fluid.

For example, the cooling member 22 comprises heat exchange with the working circuit 20 (second set of pipes 7) in order to cool the fluid at the outlet of the transfer member 6 (for example at 1.3 to 1.4K).

The working circuit 20 also comprises a cryogenic pumping member 8 situated between the boiler 5 and the transfer member 6.

Preferably, the device 1 therefore comprises at least one thermally insulated cold box 29 which contains all or some of the cold components (cryogenic components of the device 1). The pumping member 8 is situated in the cold box 29.

This cryogenic pumping member 8 thus preferably operates at cold temperatures between the temperature of the boiler and the ambient temperature (excluding the ambient temperature).

The transfer member 6 is preferably situated outside the cold box 29 (for example at ambient temperature) but could also be situated in the cold box 29 in certain variants.

This cryogenic pumping member 8 is configured to pump the fluid for example at a temperature of 1.8K to 4K. This pumping member 8 comprises for example a pump of the turbomolecular, "Holweck", centrifugal-wheel type, or any combination of these technologies.

This pumping member 8 is configured for a low pressure (around 0.1 millibar for example) and a low temperature (for example around 700/850 mK) in accordance with the operation of the boiler 5. This cryogenic pumping member 8 is preferably configured to pump helium-3 at a pressure of around 0.1 mbar or less.

This architecture with a pumping member 8 in the cold part of the circuit 20 makes it possible to increase the cycle fluid flow rate and therefore the cooling power produced. This arrangement makes it possible in particular to reach produced cooling powers that could not be achieved by the known systems (on account in particular of the sizes of the compressors 6 that are required and of the expected efficiency).

This arrangement allows better pumping efficiency with a pump 8 of relatively small size operating under cold conditions (for example at 4K or 1.8K) with a short pumping line and therefore without a reduction in the intake pressure caused by pressure drops. This is not possible in the conventional configuration with only one pumping member 6 or pump situated at ambient temperature (pressure drops in the intake pipework, etc.).

In the embodiment in [FIG. 2], the device comprises a plurality of counter-current heat exchangers 9 in the circuit 20 between the mixing chamber 3 and the boiler 5.

In addition, the device 1 has a second portion 10 for heat exchange between at least a part of the first set of pipes 2, 4 and the second set of pipes 7 and situated between the boiler 5 and the transfer member 6. This second exchange portion 10 may comprise a counter-current heat exchanger between the two sets of pipes 2, 7. This heat exchanger 10 may be in heat exchange with a cooling member 12 which thus ensures pre-cooling of the cycle fluid (for example at a temperature of around 4K).

Another (third) heat exchange portion 23 may be provided (in addition or alternatively) between the pumping member 8 and the boiler 5. This third heat exchange portion 23 may be provided for example to ensure pre-cooling of the cycle fluid (for example at a temperature of around 1.8K). The third heat exchange portion 23 may receive cold from a cooling member 22.

As illustrated, the circuit 20 may have a portion 11 for heat exchange between the second set of pipes 7 and the boiler 5. This heat exchange may for example bring the cycle fluid to a temperature of around 0.6 to 1K, for example.

In the mixing chamber 3, the fluid may reach a temperature of less than 20 mK, for example down to 5 mK.

The fluid in the boiler 5 has, for example, a pressure of between 0.05 and 0.1 mbar.

This architecture allows pumping in the pipe 4, 2 rising to ambient temperature at a higher pressure than in the configuration of the known systems. This architecture makes it possible to limit the problems of pressure drops in the pumping line up to ambient temperature and a reduction in the volumetric flow rate in the compression member 6. This pumping member 8 ensures cold compression which increases the flow rate while drastically reducing the size and the energy required for pumping (compared with the architectures with compressions at ambient temperature).

This pumping member 8 can pump the fluid for example at a delivery pressure of between 10 and 500 mbar, in particular 300 mbar.

Note that the cryogenic pumping member 8 may be situated at any cycle temperature 20 between the boiler 5 and the transfer member 6 (in particular in the case of the compressor) which is at ambient temperature.

This makes it possible, where necessary, to choose the temperature level of the cycle fluid that will be pumped (for example in the case of technological constraint, thermal dissipation of the cryogenic pump, etc.).

This pumping member 8 may, where necessary, be thermalized (that is to say cooled or kept cold) by the above-mentioned cooling member 22 (or another cooling member 12 of the device).

In the embodiment in [FIG. 3], the transfer member 6 comprises or is made up of a heat exchanger 26 which is preferably likewise in the cold part of the device 1. This means that, at the outlet of the cryogenic pumping member 8, the pumped fluid is kept cold before being returned into the second set of pipes 7 of the circuit 20. This configuration can be obtained after starting of the device which has a hot transfer member 6 such as a compressor as described above. This means that the device is started for example in the configuration in [FIG. 2] and then the compressor 6 is taken out of the circuit or bypassed by a cold exchanger 6 and the whole of the device 1 is cold (in a cold box, for example).

The exchanger 26 of the transfer member 6 may be configured to exchange heat with a cold source (a cooling member 22, for example) for the purpose of pre-cooling, for example at a temperature of 4K.

In this architecture, there is no system for compression at ambient temperature at the outlet of the cryogenic pumping member 8. This entirely cold loop is simpler and less expensive while being efficient.

The at least one cooling member 22, 12 which is provided to cool or pre-cool the cycle fluid preferably comprises a cryogenic refrigerator (and/or liquefier).

An example of the combination of such a refrigerator and a dilution refrigeration device is shown in [FIG. 4] (or more schematically in [FIG. 8]).

The refrigerator 12 comprises generally a working circuit 13 that forms a loop and contains a working fluid (comprising preferably helium and optionally at least one other gas: hydrogen, nitrogen, argon, etc.), cf. [FIG. 4].

The working circuit 13 forms a cycle comprising, in series:

- a mechanism 14 for compressing the working fluid (one or more compressors in series and/or in parallel),
- a mechanism 15 for cooling the working fluid (counter-current heat exchanger(s), for example),
- a mechanism for expanding the working fluid (one or more turbo-expanders 16 and/or expansion valves 17 of the Joule-Thomson type or the like),
- a mechanism for heating the working fluid (for example counter-current heat exchanger(s) for heating the working fluid returning to the compression mechanism).

As illustrated, at least one cold compressor 25 can be provided in the circuit upstream of the counter-current exchanger 15 and upstream of the return into the compression mechanism 14.

Preferably, the working gas is subjected, in the circuit, to a thermodynamic cycle of the reverse Ericsson or Claude type.

The refrigerator 12 has at least one portion 18, 27 for heat exchange between the working fluid expanded in the expansion mechanism 16 and at least a part of the cycle fluid of the dilution refrigeration device 1, for cooling and/or pre-cooling.

The cryogenic refrigerator 12 preferably comprises at least one tank 19 for storing liquefied working gas downstream of the mechanism 16, 17 for expansing the working fluid. The refrigerator 12 is configured to liquefy the working fluid in the tank or tanks 19.

The portion or portions 18, 27 for heat exchange between the expanded working fluid and at least a part of the cycle fluid of the dilution refrigeration device 1 preferably comprises heat exchange between the liquefied working fluid situated in the at least tank 19 and the cycle fluid of the dilution refrigeration device 1.

In the nonlimiting example in [FIG. 4] or [FIG. 8], the cryogenic refrigerator 12 comprises two tanks 19 for storing liquefied working gas that are situated at different locations in the working circuit. Thus, the refrigerator 12 is configured to liquefy the cycle fluid in said tanks 19 at different respective cycle temperatures (for example, depending on the direction of circulation of the working fluid, at 4K for the liquid helium and at 1.8K for the liquid, respectively).

The liquefied working fluids situated in said tanks 19 are placed in heat exchange with the cycle fluid of the dilution refrigeration device at respective different locations 18, 27 in the working circuit of the dilution refrigeration device 1.

In this schematic depiction, the heat exchange between the liquefied fluid and the cycle fluid of the dilution refrigeration device 1 is symbolized by a heat exchange portion of the working circuit 20 with the bath of the tanks. More specifically, a first portion 27 of the second set of pipes 7 (and/or portion 18 of the first set of pipes 4) is in direct heat exchange with the interior of one tank 19 and a second portion 27 of the second set of pipes 7 (and/or portion 18 of the first set of pipes 2) is in direct heat exchange with the interior of the other tank 19.

As illustrated, all the cold (cryogenic) parts of the installation can be disposed in a thermally and vacuum-insulated cold box 29. This means that only the transfer member 6 (compressor) and the compression mechanism 14, which are at a non-cryogenic temperature (for example ambient temperature), are outside the cold box 29.

All or part of this cooling and/or pre-cooling system may be applied to the dilution refrigeration device 1 of the embodiment in [FIG. 3]. This means that the cooling/pre-cooling member or members 12, 22 of the device in [FIG. 3] can comprise or be made up of the same above-described refrigeration device from [FIG. 4], for example a Claude-cycle pre-cooling refrigeration having an available cooling power at 4 to 5K and 1 to 2K, for example. This means that a liquefier or refrigerator 12 can supply all or part of the cooling power to the dilution refrigeration device 1 in [FIG. 3]. In this case, the cold transfer member 6(cold heat exchanger 26) could also be in the cold box 29 (only the compression mechanism 14 would be disposed outside).

As shown in the examples in [FIG. 5], or more schematically in [FIG. 9], the dilution refrigeration device 1 may have a plurality of dilution loops that each have respective mixing chambers 3 and boilers 5. The cycle fluid working circuit 20 can thus comprise a plurality of separate first sets of pipes 2, 4 and a plurality of separate second sets of pipes 7. This means that the production of cold can comprise a plurality of dilution systems which preferably share at least some of the constituent members. This is schematically shown in particular in [FIG. 5], in which two dilution loops have been depicted and two other potential loops have been symbolized using dashed lines. The elements that have already been described are denoted by the same reference numerals and are not explained in detail a second time. In [FIG. 9], only three dilution loops are shown.

Thus, at least some of the plurality of dilution loops may comprise a common transfer member 6 (compressor and/or exchanger as described above). This means that the cycle fluid circulating in a plurality of dilution loops passes through one and the same shared transfer member 6. The corresponding first sets of pipes 2, 4 and second sets of pipes 7 can thus be connected in parallel to the common transfer member 6.

Similarly, at least some of the plurality of dilution loops may comprise a common pumping member 8, meaning that the cycle fluid circulating in a plurality of dilution loops passes (is pumped) through one and the same shared pumping member 8 in a common collecting pipe. The corresponding first sets of pipes 2, 4 and/or second sets of pipes 7 can then be connected in parallel to said common pumping member 8. This is optional, however. Thus, in a variant or in combination, one or more or all of the different dilution loops may comprise one or more pumping members 8 of their own, which is/are not shared. This means that, in addition to the shared pumping members 8, one or more dilution loops may comprise one or more pumping members 8 situated in a pipe which is not shared with another dilution loop.

In addition, as illustrated, all or some of these multiple dilution refrigeration systems may be pre-cooled and/or cooled by one and the same cooling/pre-cooling member 12, 22.

The common cooling apparatus may thus comprise a cryogenic refrigerator 12 as described above (comprising a working circuit 13 that forms a loop and contains a working fluid containing for example helium, the working circuit 13 forming a cycle that comprises, in series: a mechanism 14 for compressing the working fluid, a mechanism 15 for cooling the working fluid, a mechanism 16, 17 for expanding the working fluid and a mechanism 15 for heating the working fluid). This refrigerator 12 comprises at least one portion 18 for heat exchange between the working fluid expanded in the expansion mechanism 16 and at least a part of the cycle fluid of the plurality of separate dilution loops of the dilution refrigeration device.

As before, the cryogenic refrigerator forming the common cooling apparatus may comprise at least one tank 19 for storing liquefied working gas (in particular two tanks). The device comprises a transfer pipe 21 connecting each storage tank 19 to at least one portion 18 of at least some of the plurality of separate dilution loops of the dilution refrigeration device in order to carry out heat exchange between the working fluid and the cycle fluid in each of said dilution loops of the dilution refrigeration device. The fluid that was used to cool/pre-cool the dilution loops is returned to the working circuit 13 via a respective return pipe 121.

FIG. 6 shows a schematic view of a possible example part of the structure of a part of one of the dilution loops in [FIG. 5]. In this example, the cryogenic pumping member 8 is shared (and is not shown). This means that the fluid exiting the boiler 5 is returned to the common pumping member 8. The pre-cooling of the dilution loop comprises a first reserve 18 of liquefied cooling fluid (for example at a temperature of 4K) in heat exchange with the dilution loop (in particular the second example of a pipe 7) upstream of the boiler 5. Similarly, the pre-cooling of the dilution loop comprises a second reserve 18 of liquefied cooling fluid (for example at a temperature of 1.8K) in heat exchange with the dilution loop (in particular the second example of a pipe 7) between the first reserve and the boiler 5. Each of the reserves 18 is connected to the common refrigerator 12 via respective transfer pipes 21 and liquid return pipes 121.

FIG. 7 shows the possible arrangement of the fluidic connections of the different dilution loops to the common refrigerator. Shown in the upper part are six transfer pipes 21 that respectively supply the reserves 18 of six liquefying loops in order to pre-cool them and the six respective return pipes 121 that return the liquefied cryogenic fluid that has been used to pre-cool six dilution loops. As schematically shown on two lines, the transfer pipes 21 may each comprise a valve 28 for controlling or stopping the flow.

The transfer pipes 21 are connected to a first tank 19 for storing liquefied working gas. The return pipes 121 are connected to the working circuit.

The ends of the first sets of pipes 2 are connected to a collecting pipe comprising the common cryogenic pumping member 8.

Shown in the lower part are six transfer pipes 21 that respectively supply the reserves 18 of six liquefying loops in order to cool them and the six respective return pipes 121 that return the liquefied cryogenic fluid that has been used to cool six dilution loops.

The transfer pipes 21 are connected to a second tank 19 for storing liquefied working gas. The return pipes 121 are connected to the working circuit.

Thus, the device 1 according to the invention allows a distributed architecture comprising a plurality of (six in this example, although it could be any other number, for example ten or more) separate dilution loops that produce cold and are cooled by a central member 12 or cryostat for pre-cooling cycle fluids from ambient temperature to a target cryogenic temperature (for example 4K and/or 1.8K).

According to one possibility, the cryogenic pumping member 8 of the boilers 5 of the cold stages of the satellite dilutions is shared.

In this way, it is possible to implement cold parts of dilutions with reasonable flow rates for the counter-current exchangers 9. Moreover, this architecture having multiple dilution loops makes it possible, in addition to its modularity, to insulate one or more loops for repairs while the other dilution loops are active.

The common cooling member 12 makes it possible to effectively cool the various components.

The invention makes it possible to increase the pumping flow rate capacity, which increases the cooling power produced by dilution.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context dearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A dilution refrigeration device for achieving temperatures between one and around 100 millikelvin, comprising:

a working circuit in the form of a loop containing a cycle fluid comprising a mixture of helium-3 (3He) and helium-4 (4He), the working circuit comprising, in series:

a mixing chamber, a boiler, a transfer member, a first set of pipes fluidically connecting the mixing chamber, boiler, and transfer member, the first set of pipes being configured to transfer cycle fluid from an outlet of the mixing chamber to an inlet of the boiler and from an outlet of the boiler to an inlet of the transfer member, and a second set of pipes connecting an outlet of the transfer member to an inlet of the mixing chamber;

at least a first heat exchanger portion for heat exchange between at least a part of the first set of pipes and the second set of pipes, the first heat exchange portion being situated between the boiler and the mixing chamber;

at least one cooling member which is in heat exchange with the working circuit and is configured to transfer cold energy to the cycle fluid;

at least one thermally insulated cold box which contains parts of the dilution refrigeration device at cryogenic temperatures; and at least one cryogenic pumping member situated within the at least one thermally insulated cold box and integrated in the working circuit, wherein the at least one cryogenic pumping member is further situated between the boiler and the transfer member, wherein the at least one cryogenic pumping member is configured to perform cold compression at a low temperature below 1 K.

2. The dilution refrigeration device of claim 1, wherein the transfer member comprises a cycle fluid compressor.

3. The dilution refrigeration device of claim 1, wherein the transfer member comprises a heat exchanger.

4. The dilution refrigeration device of claim 1, wherein the at least one cryogenic pumping member is situated in the first set of pipes and, in an operating configuration of the dilution refrigeration device, the cycle fluid is admitted thereinto at a temperature between 0.5K and 80K.

5. The dilution refrigeration device of claim 1, wherein the at least one cryogenic pumping member is configured to pump the cycle fluid at an intake pressure of between 0.01 mbar and 100 mbar.

6. The dilution refrigeration device of claim 1, further comprising a second heat exchange portion for heat exchange between at least a part of the first set of pipes and the second set of pipes, the second heat exchanger portion being situated between the boiler and the transfer member, wherein the at least one cryogenic pumping member is situated between the second heat exchange portion and the boiler and/or between the second heat exchange portion and the transfer member.

7. The dilution refrigeration device of claim 1, wherein the at least one cooling member has a cooling apparatus in heat exchange with the second set of pipes between the transfer member and the mixing member, the cooling member being configured to cool the cycle fluid of the dilution refrigeration device.

8. The dilution refrigeration device of claim 1, further comprising another heat exchange portion for heat exchange between the second set of pipes and the boiler.

9. The dilution refrigeration device of claim 1, wherein:

the at least one cooling member comprises a cryogenic refrigerator that comprises a working circuit that forms a loop and contains a working fluid comprising helium;

the working circuit of the cryogenic refrigerator forming a cycle comprising, in series, a mechanism for compressing the working fluid, a mechanism for cooling the working fluid, a mechanism for expanding the working fluid, and a mechanism for heating the working fluid; and the cryogenic refrigerator comprises at least one portion for heat exchange between the working fluid expanded in the expansion mechanism and at least a part of the cycle fluid of the dilution refrigeration device.

10. The dilution refrigeration device of claim 9, wherein:

the cryogenic refrigerator further comprises at least one tank for storing liquefied working gas downstream of the mechanism for expanding the working fluid;

the cryogenic refrigerator is configured to liquefy the working fluid in said tank; and the at least one portion for heat exchange between the expanded working fluid and at least a part of the cycle fluid of the dilution refrigeration device comprises heat exchange between the liquefied working fluid situated in the at least one tank and the cycle fluid of the dilution refrigeration device.

11. The dilution refrigeration device of claim 10, wherein:

the cryogenic refrigerator further comprises at least two tanks for storing liquefied working gas which are situated at separate locations in the working circuit;

the cryogenic refrigerator is configured to liquefy cycle fluid in said tanks at different respective temperatures; and the liquefied working fluids situated in said tanks are placed in heat exchange with the cycle fluid of the dilution refrigeration device at separate respective locations in the working circuit of the dilution refrigeration device.

12. The dilution refrigeration device of claim 1, wherein the working circuit of said dilution refrigeration device comprises a plurality of dilution loops each of which has respective mixing chambers and boilers such that the cycle fluid working circuit comprises a plurality of separate first sets of pipes and a plurality of separate second sets of pipes.

13. The dilution refrigeration device of claim 12, wherein at least some of the plurality of dilution loops comprise a common transfer member such that the cycle fluid circulating in a plurality of dilution loops passes through a same shared transfer member, the corresponding first sets of pipes and second sets of pipes being connected in parallel to the common transfer member.

14. The dilution refrigeration device of claim 12, wherein at least some of the plurality of dilution loops comprise a common pumping member such that the cycle fluid circulating in a plurality of dilution loops passes through a same shared pumping member, the corresponding first sets of pipes and/or second sets of pipes being connected in parallel to said common pumping member.

15. The dilution refrigeration device of claim 12, wherein at least some of the plurality of dilution loops each comprises a respective separate pumping member.

16. The dilution refrigeration device of claim 12, wherein the at least one cooling member has a common cooling apparatus for cooling at least some of the plurality of separate dilution loops.

17. The dilution refrigeration device of claim 16, wherein:

the common cooling apparatus comprises a cryogenic refrigerator that comprises a working circuit that forms a loop and contains a working fluid containing helium;

the working circuit of the cryogenic refrigerator forming a cycle comprising, in series:

a mechanism for compressing the working fluid, a mechanism for cooling the working fluid, a mechanism for expanding the working fluid and a mechanism for heating the working fluid; and the cryogenic refrigerator comprising at least one portion for heat exchange between the working fluid expanded in the expansion mechanism and at least a part of the cycle fluid of the plurality of separate dilution loops of the dilution refrigeration device.

18. The dilution refrigeration device of claim 17, wherein:

the cryogenic refrigerator forming the common cooling apparatus comprises at least one tank for storing liquefied working gas downstream of the mechanism for expanding the working fluid;

the cryogenic refrigerator is configured to liquefy the working fluid in said at least one tank; and the dilution refrigeration device further comprises a transfer pipe connecting said at least one storage pipe to at least one portion of at least some of the plurality of separate dilution loops of the dilution refrigeration device in order to ensure heat exchange between the working fluid and the cycle fluid in each of said dilution loops of the dilution refrigeration device.

19. The dilution refrigeration device of claim 17, wherein:

the cryogenic refrigerator forming the at least one common cooling member comprises at least two tanks for storing liquefied working gas which are situated at separate locations in the working circuit;

the cryogenic refrigerator is configured to liquefy cycle fluid in said tanks at different respective temperatures; and the dilution refrigeration device has a set of transfer pipes connecting the storage tanks respectively to separate portions of at least some of the plurality of dilution loops of the dilution refrigeration device, in order to ensure exchanges of heat between the working fluid and the cycle fluid in said dilution loops of the dilution refrigeration device.

20. A method for cooling at least one user member, the method comprising the steps of:

providing the dilution refrigeration device of claim 1 wherein the at least one user member is in thermal contact with the mixing chamber; and operating the cryogenic pumping member to move cycle fluid in the working circuit, thereby cooling the at least one user member.

21. The dilution refrigeration device of claim 1, wherein the at least one cryogenic pumping member is configured to perform cold compression of the primary cycle fluid while being thermalized by at least one cooling member to mitigate parasitic heat dissipation into the working circuit.

* * * * *